US009638087B2

(12) United States Patent
Kim

(10) Patent No.: US 9,638,087 B2
(45) Date of Patent: May 2, 2017

(54) TAILPIPE FOR MUFFLER OF VEHICLE HAVING MULTIPLE INNER PIPES

(71) Applicant: Hyundai Motor Company, Seoul (KR)

(72) Inventor: Ju-In Kim, Seongnam-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/935,152

(22) Filed: Nov. 6, 2015

(65) Prior Publication Data

US 2016/0348563 A1 Dec. 1, 2016

(30) Foreign Application Priority Data

May 29, 2015 (KR) ..... 10-2015-0076304

(51) Int. Cl.

| | |
|---|---|
| ***F01N 13/08*** | (2010.01) |
| ***F02K 1/44*** | (2006.01) |
| *F01N 13/00* | (2010.01) |
| *F02K 1/00* | (2006.01) |

(52) U.S. Cl.

CPC ..... *F01N 13/082* (2013.01)

(58) Field of Classification Search

CPC ..... F01N 13/082; F02C 3/13; F02K 1/386; F02K 1/46; F02K 1/20; F02K 1/36; F02K 1/38

USPC ..... 181/227, 228, 239, 251, 257, 213; 60/263

See application file for complete search history.

(56) References Cited

U.S. PATENT DOCUMENTS

| | | | | | |
|---|---|---|---|---|---|
| 1,855,165 | A | * | 4/1932 | Barker | B01D 53/944 181/239 |
| 2,019,697 | A | * | 11/1935 | Smith | F01N 1/08 181/239 |
| 2,075,316 | A | * | 3/1937 | Tyden | F01N 1/08 181/251 |
| 2,633,703 | A | * | 4/1953 | Tenney | F02K 1/40 60/248 |
| 2,896,739 | A | * | 7/1959 | Kuras | F01N 1/00 181/239 |
| 2,995,200 | A | * | 8/1961 | Seifert | F01N 1/06 181/213 |
| 2,996,139 | A | * | 8/1961 | Patterson | F01N 1/08 181/239 |
| 3,139,153 | A | * | 6/1964 | De Remer | F02K 1/40 181/220 |
| 3,447,630 | A | * | 6/1969 | Davidson | F01N 1/08 181/239 |
| 3,572,463 | A | * | 3/1971 | Eschenburg | F02K 1/40 181/215 |
| 3,612,212 | A | * | 10/1971 | Macdonald | F02K 1/40 181/175 |

(Continued)

FOREIGN PATENT DOCUMENTS

| | | | |
|---|---|---|---|
| JP | 2005-256644 | A | 9/2005 |
| JP | 2006-250022 | A | 9/2006 |

(Continued)

*Primary Examiner* — Edgardo San Martin

(74) *Attorney, Agent, or Firm* — Morgan, Lewis & Bockius LLP

(57) ABSTRACT

A tailpipe for a vehicle, which has a tubular body may include a central pipe positioned in the body, and a plurality of sub-pipes which is disposed to surround an outer circumferential surface of the central pipe.

8 Claims, 10 Drawing Sheets

(56) References Cited

U.S. PATENT DOCUMENTS 3,927,522 A * 12/1975 Bryce ..... F02K 1/38 181/215
4,036,452 A * 7/1977 Schairer ..... F02K 1/42 181/217
4,254,620 A * 3/1981 Wright ..... B64C 9/38 181/220
D271,963 S * 12/1983 Perkins ..... D12/194
6,006,859 A * 12/1999 Hussaini ..... F01N 13/1855 181/227
D447,456 S * 9/2001 Larson ..... D12/194
D484,772 S * 1/2004 Wiesenthal ..... D12/114
7,086,224 B1 * 8/2006 Perry ..... F01N 13/082 446/176
7,089,731 B1 * 8/2006 Perry ..... F01N 1/18 446/176
7,628,012 B2 * 12/2009 Eifert ..... F01N 13/082 60/319
7,882,696 B2 * 2/2011 Anderson ..... F01D 25/28 181/220
8,534,056 B2 * 9/2013 Batdorff ..... F01N 3/02 60/298
8,549,850 B2 * 10/2013 Janakiraman ..... F01N 3/05 60/219
2006/0151238 A1 * 7/2006 Giordano ..... F01N 1/166 181/227

FOREIGN PATENT DOCUMENTS

KR 10-1998-050770 A 9/1998
KR 10-1998-063866 U 11/1998
KR 10-0321361 B1 1/2002
KR 10-2008-0013384 A 2/2008

* cited by examiner

TAILPIPE FOR MUFFLER OF VEHICLE HAVING MULTIPLE INNER PIPES

CROSS-REFERENCE TO RELATED APPLICATIONS

The present application claims priority to Korean Patent Application No. 10-2015-0076304, filed May 29, 2015, the entire contents of which is incorporated herein for all purposes by this reference.

BACKGROUND OF THE INVENTION

Field of the Invention

The present invention relates to a tailpipe for a muffler of a vehicle, and more particularly, to a tailpipe for a vehicle, which includes a central pipe which is positioned in a tubular body, and a plurality of sub-pipes which is disposed to surround an outer circumferential surface of the central pipe.

Description of Related Art

In general, an exhaust system for a vehicle broadly includes a purifier and a muffler.

The purifier is a device that removes substances hazardous to humans, such as carbon monoxide or nitrogen compounds contained in exhaust gas discharged when an engine is operated, and the muffler serves to reduce noise of exhaust gas discharged from the vehicle.

FIG. 1 illustrates a typical muffler for a vehicle. A muffler 1 has an inlet pipe 2 into which exhaust gas discharged from an engine flows, and a tail pipe 3 through which the exhaust gas is discharged to the outside of the muffler 1.

A velocity of exhaust gas discharged from the muffler 1 is increased as a rotational speed (RPM) of the engine is increased due to improvement in performance of the engine, whereby noise of exhaust gas is also increased.

FIG. 2 illustrates a velocity $V_g$ of exhaust gas G discharged through the tailpipe 3 of the muffler, and a velocity $V_a$ of air (atmospheric air) A at the periphery of the tailpipe 3. As illustrated, there is a great difference between the velocity $V_g$ of the exhaust gas and the velocity $V_a$ of the peripheral air at a boundary B between the exhaust gas G and the peripheral air A, and the greater the difference in velocity between the exhaust gas G and the peripheral air A, the more increased the gas flow noise outside of the tailpipe 3.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a tailpipe for a muffler of a vehicle, which is capable of reducing gas flow noise outside of the tailpipe, and enhancing a function of a muffler that reduces noise of exhaust gas, by decreasing a difference in velocity between discharged exhaust gas and air at the periphery of the tailpipe by improving a structure of the tailpipe of the muffler.

According to various aspects of the present invention, a tailpipe for a vehicle, which has a tubular body, may include a central pipe positioned in the body, and a plurality of sub-pipes which is disposed to surround an outer circumferential surface of the central pipe.

A length of the central pipe may be shorter than a length of each sub-pipe, and a diameter of the central pipe may be greater than a diameter of each sub-pipe.

Portions of the sub-pipes, which are exposed to an outside of the body of the tailpipe, may have a same length.

A length of a portion of the central pipe, which is exposed to the outside of the body of the tailpipe, may be shorter than the length of the portions of the sub-pipes which are exposed to the outside of the body.

Portions of the sub-pipes, which are exposed to an outside of the body of the tailpipe, may have different lengths.

The length of the exposed portions of the sub-pipes may be gradually increased from a lower side to an upper side of the central pipe.

The central pipe and the sub-pipes may be fixed by perpendicularly penetrating a circular plate-shaped fixing plate mounted in the body.

According to various embodiments of the present invention, a velocity gradient is formed to be gradual by decreasing a difference between a velocity of exhaust gas discharged through the sub-pipes of the tailpipe, a velocity of exhaust gas discharged through the central pipe, and a velocity of peripheral air, thereby significantly reducing gas flow noise outside of the tailpipe.

In addition, according to various embodiments of the present invention, the present invention is a very advanced invention in that exhaust gas discharged through the tailpipe produces a global velocity gradient from an upper side to a lower side, and the exhaust gas is rapidly mixed with the peripheral air by a vortex caused by the global velocity gradient, thereby quickly reducing noise of the exhaust gas.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 3:
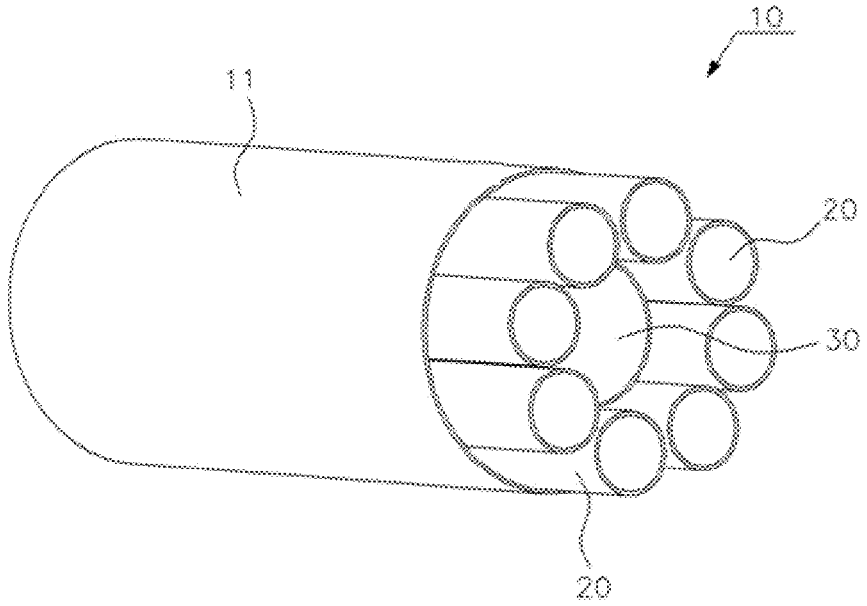
FIG. 3 is a perspective view of an exemplary tailpipe according to the present invention.
Figure 4:
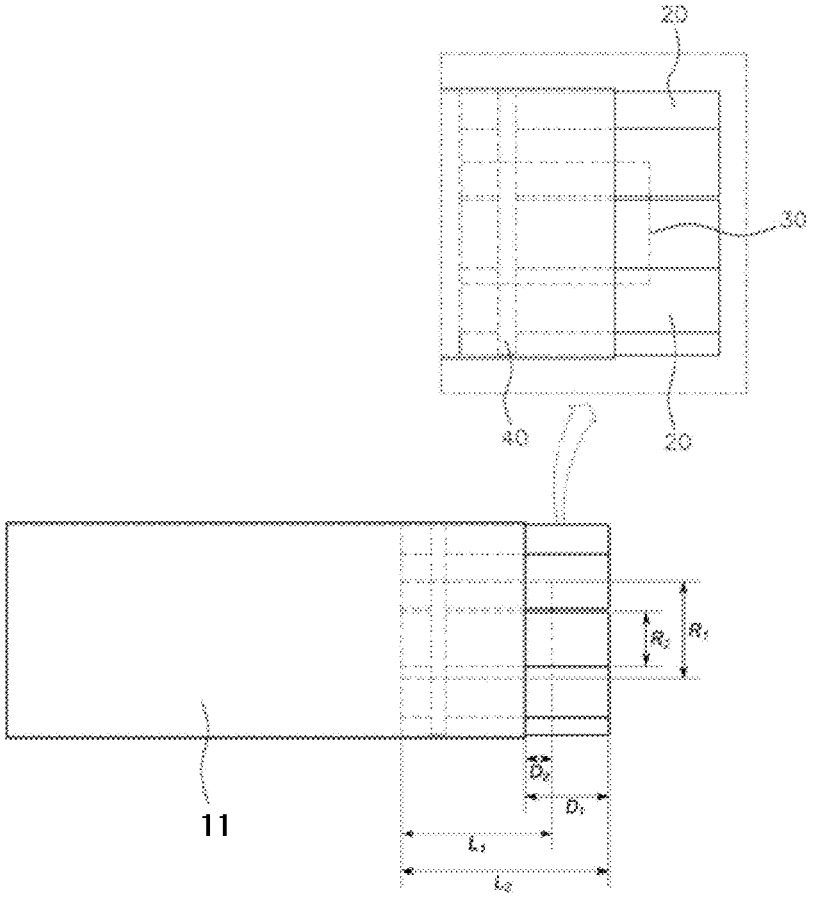
FIG. 4 is a side view of the exemplary tailpipe according to the present invention.

FIG. 3 is a perspective view of a tailpipe according to various embodiments of the present invention, and FIG. 4 is a side view of the tailpipe according to various embodiments of the present invention.

Referring to the drawings, a tailpipe 10 according to various embodiments of the present invention includes a central pipe 30 which is positioned in a vacant hollow tubular body 11, and a plurality of sub-pipes 20 which is disposed to surround an outer circumferential surface of the central pipe 30.

Here, the body of the tailpipe 10 may have a cylindrical shape.

In this case, a length $L_1$ of the central pipe 30 is shorter than a length $L_2$ of the sub-pipe 20, and a diameter $R_1$ of the central pipe 30 is greater than a diameter $R_2$ of the sub-pipe 20.

The central pipe 30 and the sub-pipes 20 perpendicularly penetrate a circular plate-shaped fixing plate 40, and the fixing plate 40 is closely mounted in the body 11 without gaps so as to prevent the exhaust gas flowing into the muffler from leaking.

In addition, the sub-pipes 20 all have the same length $L_2$, and portions of the sub-pipes 20, which are exposed to the outside of the body 11 of the tailpipe, all have the same length $D_1$.

In addition, a length $D_2$ of a portion of the central pipe 30, which is exposed to the outside of the body 11 of the tailpipe, is shorter than the length $D_1$ of the portions of the sub-pipes 20 which are exposed to the outside of the body 11.

The central pipe 30 and the sub-pipes 20 are attached to the circular plate-shaped fixing plate 40 by welding, and the fixing plate 40, to which the central pipe 30 and the sub-pipes 20 are attached, is fixed by being press-fitted into the body 11 of the tailpipe, such that the tailpipe 10 is manufactured.

Further, the tailpipe 10, to which the central pipe 30 and the sub-pipes 20 are fixed as described above, is coupled to a muffler body by welding, thereby applying the tailpipe according to the present invention to the muffler.

Figure 5A:
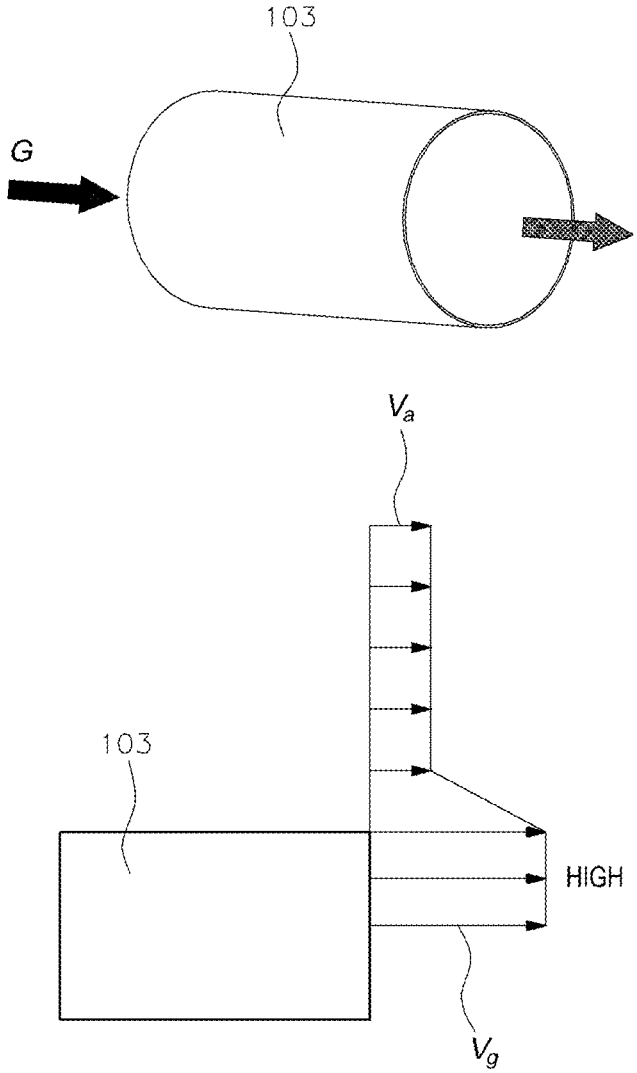
FIG. 5A is a view illustrating a state in which the typical tailpipe according to the related art is operated.
Figure 5B:
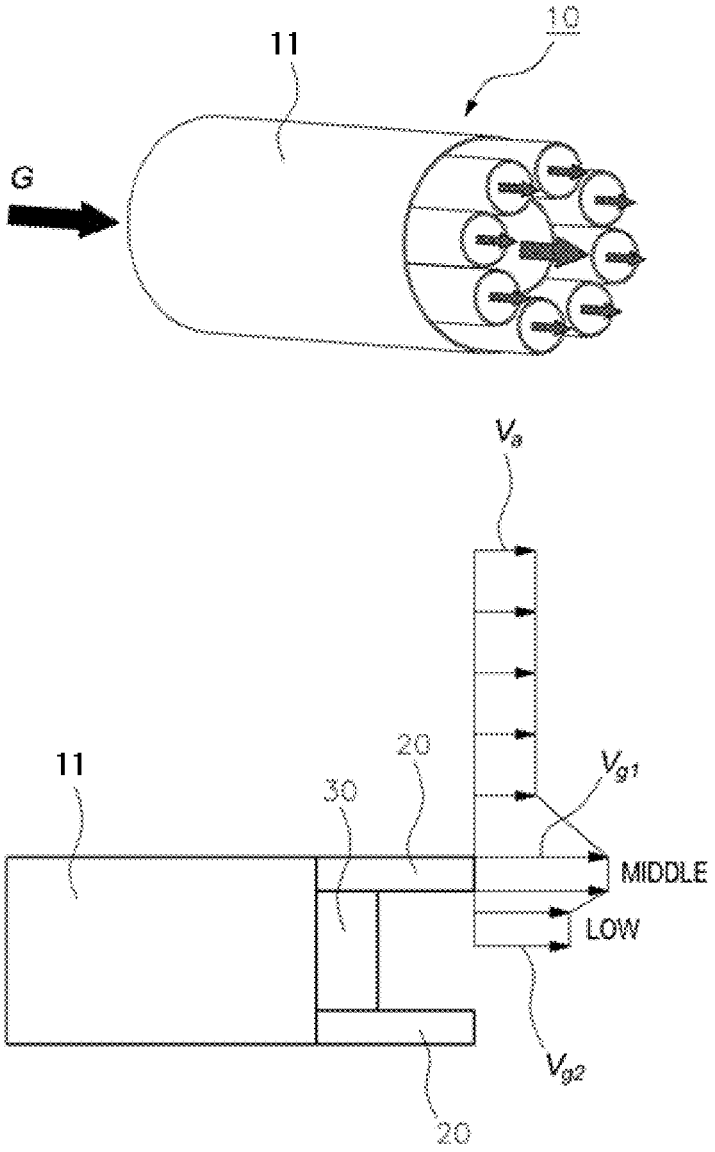
FIG. 5B is a view illustrating a state in which the exemplary tailpipe according to the present invention is operated.

FIGS. 5A and 5B are views illustrating a state in which a typical tailpipe according to the related art and the tailpipe according to various embodiments of the present invention are operated, respectively.

Figure 1:
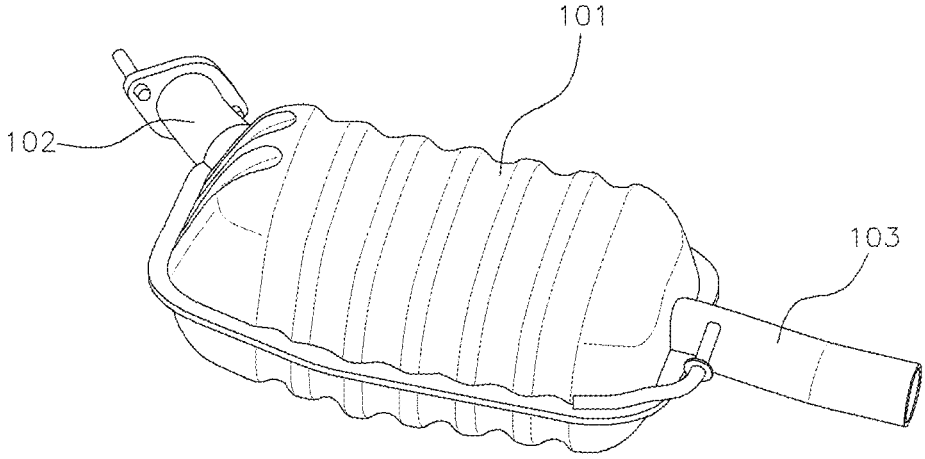
FIG. 1 (Related Art)
FIG. 1 is a view illustrating a typical muffler for a vehicle according to the related art.
Figure 2:
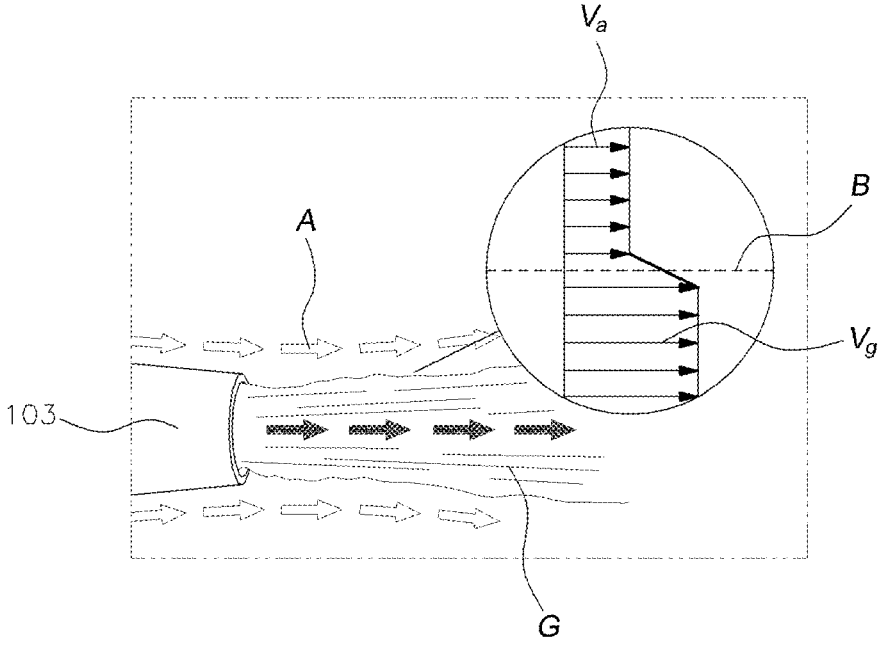
FIG. 2 (Related Art)
FIG. 2 is a view illustrating a velocity of exhaust gas discharged through a tailpipe of a muffler and a velocity of air at the periphery of the tailpipe, according to the related art.

First, FIG. 5A represents a state in which exhaust gas is discharged through the typical tailpipe that has been described with reference to FIG. 2. When comparing a velocity $V_g$ of exhaust gas G discharged through the tailpipe 3 with a velocity $V_a$ of air A at the periphery of the tailpipe 3, the velocity $V_g$ of the exhaust gas is higher than the velocity $V_a$ of the peripheral air, such that great gas flow noise occurs outside of the tailpipe 3.

In contrast, as illustrated FIG. 5B, which represents a state in which the tailpipe according to various embodiments of the present invention is operated, a velocity $V_a$ of the peripheral air A is equal to the velocity $V_a$ of the peripheral air illustrated in part A, but a length along which the exhaust gas G passes through the tailpipe 10 is increased because the exhaust gas G passing through the body 11 of the tailpipe 10 flows back into the sub-pipes 20 and then is discharged through the sub-pipes 20.

Therefore, the velocity of the exhaust gas G is decreased as much as the increased length along which the exhaust gas passes, and as a result, a velocity $V_{g1}$ of exhaust gas discharged through the sub-pipes 20 becomes lower than the velocity $V_g$ of the exhaust gas discharged through the typical tailpipe 3 illustrated in part A at the left side (i.e., $V_g > V_{g1}$, in the drawing, $V_g$ is referred to as a high velocity, and $V_{g1}$ is referred to as a middle velocity, for convenience).

In addition, the length $D_2$ of the portion of the central pipe 30, which is exposed to the outside of the body 11 of the tailpipe, is shorter than the length $D_1$ of the portions of the sub-pipes 20 which are exposed to the outside of the body 11, the length $L_1$ of the central pipe 30 is shorter than the length $L_2$ of the sub-pipe 20, and the diameter $R_1$ of the central pipe 30 is greater than the diameter $R_2$ of the sub-pipe 20, such that the exhaust gas discharged through the central pipe 30 is discharged into the air earlier than the exhaust gas discharged through the sub-pipes 20, and a velocity $V_{g2}$ of exhaust gas discharged through the central pipe 30 becomes higher than the velocity $V_a$ of the peripheral air, but lower than the velocity $V_{g1}$ of the exhaust gas discharged through the sub-pipes 20, because of resistance of air which occurs while the discharged exhaust gas reaches openings at ends of the sub-pipes 20 (i.e., $Vg_1 > V_{g2} > V_a$, in the drawing, $V_{g2}$ is referred to as a low velocity, for convenience).

Therefore, as illustrated in part B, differences between the velocity $V_{g1}$ of the exhaust gas G discharged through the sub-pipes 20 of the tailpipe 10 according to the exemplary embodiment of the present invention, the velocity $V_{g2}$ of the exhaust gas G discharged through the central pipe 30, and the velocity $V_a$ of the peripheral air are smaller than a difference between the velocity Vg of the exhaust gas discharged through the typical tailpipe 3 illustrated in part A and the velocity $V_a$ of the peripheral air, such that a velocity gradient becomes gradual, and gas flow noise outside of the tailpipe 10 is decreased.

Figure 6:
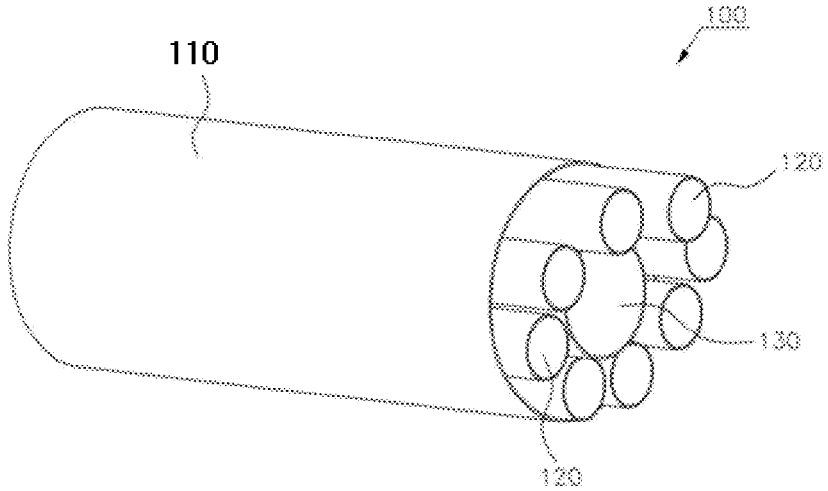
FIG. 6 is a perspective view of an exemplary tailpipe according to the present invention.
Figure 7:
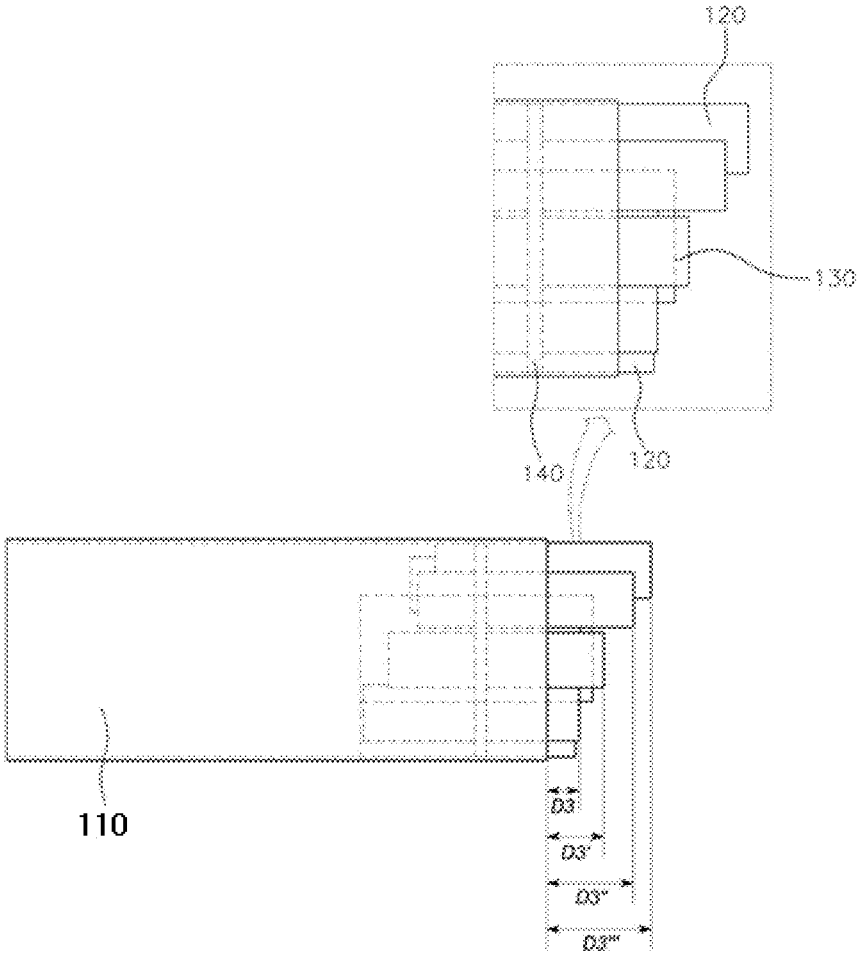
FIG. 7 is a side view of the exemplary tailpipe of FIG. 6, according to the present invention.

FIG. 6 is a perspective view of a tailpipe according to various embodiments of the present invention, and FIG. 7 is a side view of the tailpipe according to various embodiments of the present invention.

Referring to the drawings, a tailpipe 100 according to various embodiments of the present invention basically has the same structure as the tailpipe 10 of the various embodiments of FIG. 3, but portions of sub-pipes 120, which are exposed to the outside of the body 110 of the tailpipe, have different lengths D3, D3', D3", and D3'".

In more detail, various embodiments of FIG. 6 are the same as the aforementioned various embodiments of FIG. 3, in that the tailpipe 100 includes a central pipe 130 which is positioned in a vacant hollow tubular body 110, and a plurality of sub-pipes 120 which is disposed to surround an outer circumferential surface of the central pipe 130, in which a length $L_1$ of the central pipe 130 is shorter than a length $L_2$ of the sub-pipe 120, and a diameter $R_1$ of the central pipe 130 is greater than a diameter $R_2$ of the sub-pipe 120.

Here, the body 110 of the tailpipe 100 may have a cylindrical shape.

In this case, the portions of the sub-pipes 120, which are exposed to the outside of the body 110 of tailpipe, have different lengths D3, D3', D3", and D3'". The sub-pipes 120 may also have the same length, but may have different lengths.

In addition, as illustrated, a length of the exposed portion of the sub-pipe 120 positioned at an upper side of the central pipe 130 is longer than a length of the exposed portion of the sub-pipe 120 positioned at a lower side of the central pipe 130. That is, the length of the exposed portion of the sub-pipe 120 is gradually increased from the lower side to the upper side of the central pipe 130.

Meanwhile, like the various embodiments of FIG. 3, the central pipe 130 and the sub-pipes 120 perpendicularly penetrate a circular plate-shaped fixing plate 140, and the fixing plate 140 is closely mounted in the body 110 without gaps so as to prevent the exhaust gas flowing into the muffler from leaking.

The central pipe 130 and the sub-pipes 120 are attached to the circular plate-shaped fixing plate 140 by welding, and the fixing plate 140, to which the central pipe 130 and the sub-pipes 120 are attached, is fixed by being press-fitted into the body 110 of the tailpipe, such that the tailpipe 100 according to the various embodiments of FIG. 6 is manufactured.

Furthermore, the tailpipe 110, to which the central pipe 130 and the sub-pipes 120 are fixed as described above, is coupled to a muffler body by welding, thereby applying the tailpipe according to the present invention to the muffler.

Figure 8:
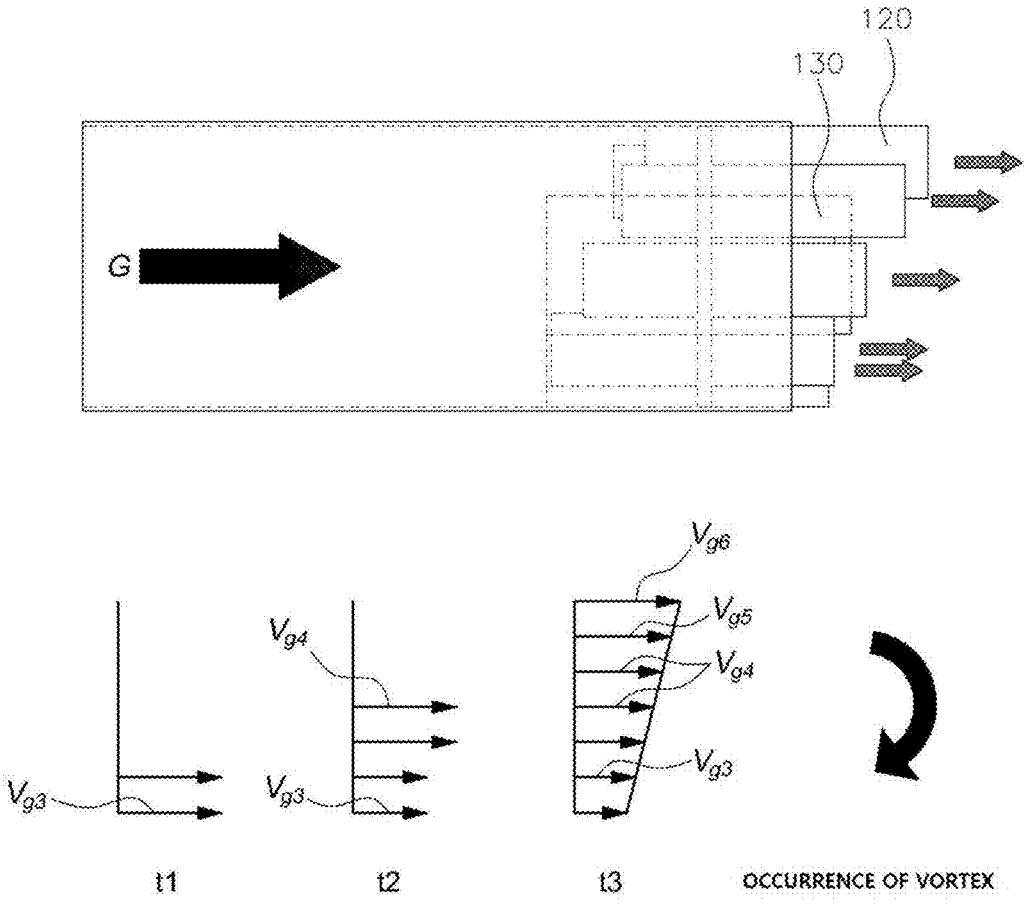
FIG. 8 is a view illustrating a state in which the exemplary tailpipe of FIG. 6, according to the present invention, is operated.

FIG. 8 is a view illustrating a state in which the tailpipe according to various embodiments of the present invention is operated.

As illustrated, the exhaust gas G passing through the body 110 of the tailpipe 100 flows back into the sub-pipes 120 and then is discharged through the sub-pipes 120, such that a length along which the exhaust gas G passes through the tailpipe 100 is increased.

However, exhaust gas is discharged through the sub-pipes 120 in a predetermined order. That is, since the portions of the sub-pipes 120, which are exposed to the outside of the body 110 of the tailpipe, have different lengths D3, D3', D3", and D3'", and the length of the exposed portion of the sub-pipe 120 positioned at the upper side of the central pipe 130 is longer than the length of the exposed portion of the sub-pipe 120 positioned at the lower side of the central pipe 130, the exhaust gas is discharged into the air first through the sub-pipe 120 positioned at the lower side of the central pipe 130, and a velocity $V_{g3}$ of the discharged exhaust gas is decreased due to resistance of air from an initial discharge time t1 to a final discharge time t3 via an intermediate discharge time t2. However, since exhaust gas, which is discharged through the sub-pipe 120 positioned at the same height as the central pipe 130, is discharged later than exhaust gas that is discharged through the sub-pipe 120 positioned at a lower end, a velocity $V_{g4}$ of exhaust gas discharged at the intermediate discharge time t2 is decreased toward the final discharge time t3, but a degree to which the velocity $V_{g4}$ of the exhaust gas is decreased is smaller than a degree to which the velocity $V_{g3}$ of the exhaust gas discharged through the sub-pipe 120 positioned at the lower end is decreased. As a result, the velocity $V_{g4}$ of the exhaust gas, which is discharged through the sub-pipe 120 positioned at the same height as the central pipe 130, is higher than the velocity $V_{g3}$ of the exhaust gas discharged through the sub-pipe 120 positioned at the lower end (i.e., $V_{g4}>V_{g3}$).

As a similar principle, since the exhaust gas, which is discharged through the sub-pipe 120 positioned at the upper side of the central pipe 130, is discharged later than the exhaust gas discharged through the sub-pipe 120 positioned at the same height as the central pipe 130, the exhaust gas, which is discharged through the sub-pipe 120 positioned at the upper side of the central pipe 130, is discharged at the final discharge time t3, so that a degree to which the velocity is decreased is small. As a result, a velocity $V_{g5}$ of the exhaust gas discharged through the sub-pipe 120 positioned at the upper side of the central pipe 130 is higher than the velocity $V_{g4}$ of the exhaust gas discharged through the sub-pipe 120 positioned at the same height as the central pipe 130 (i.e., $V_{g5}>V_{g4}$). This principle is identically applied to a velocity of exhaust gas discharged through the sub-pipe 120 positioned at an uppermost end, such that a velocity $V_{g6}$ of the exhaust gas discharged through the sub-pipe 120 positioned at the uppermost end is higher than a velocity $V_{g5}$ of the exhaust gas discharged through the sub-pipe 120 positioned at the upper side of the central pipe 130 (i.e., $V_{g6}>V_{g5}$).

Therefore, at the final discharge time t3 when the exhaust gas is discharged through the tailpipe 100 according to various embodiments of the present invention, a global velocity gradient of the velocity of the exhaust gas discharged from the tailpipe 100 is produced from the upper side to the lower side, and causes a vortex (swirl of air) of air at the periphery of the tailpipe 100, such that exhaust gas is rapidly mixed with air, thereby quickly reducing noise of exhaust gas.

Figure 9A:
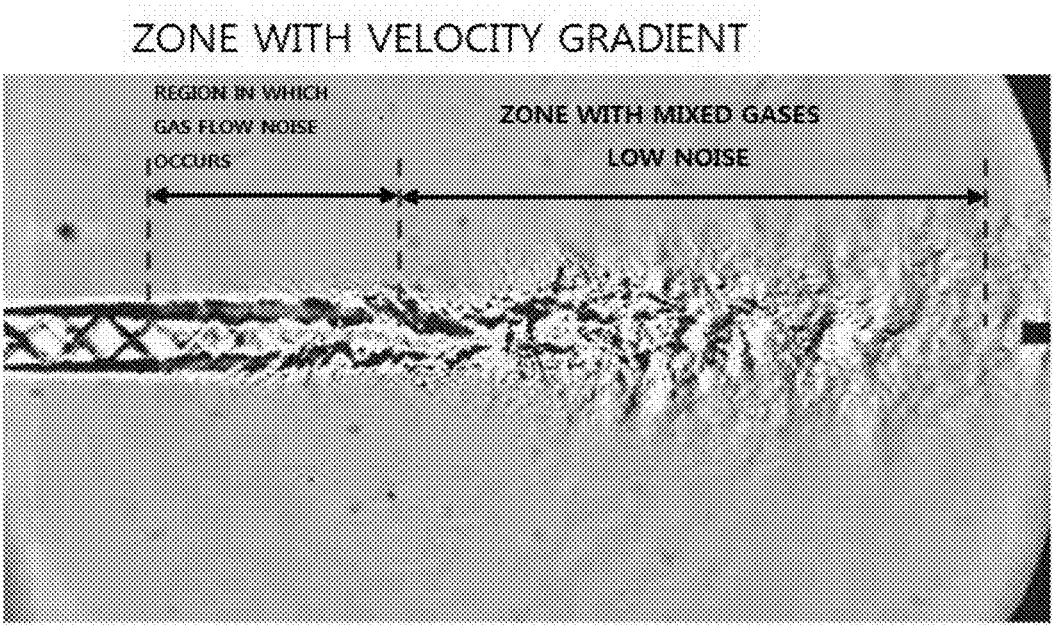
FIG. 9A illustrates a state in which exhaust gas is discharged through the typical tailpipe according to the related art.
Figure 9B:
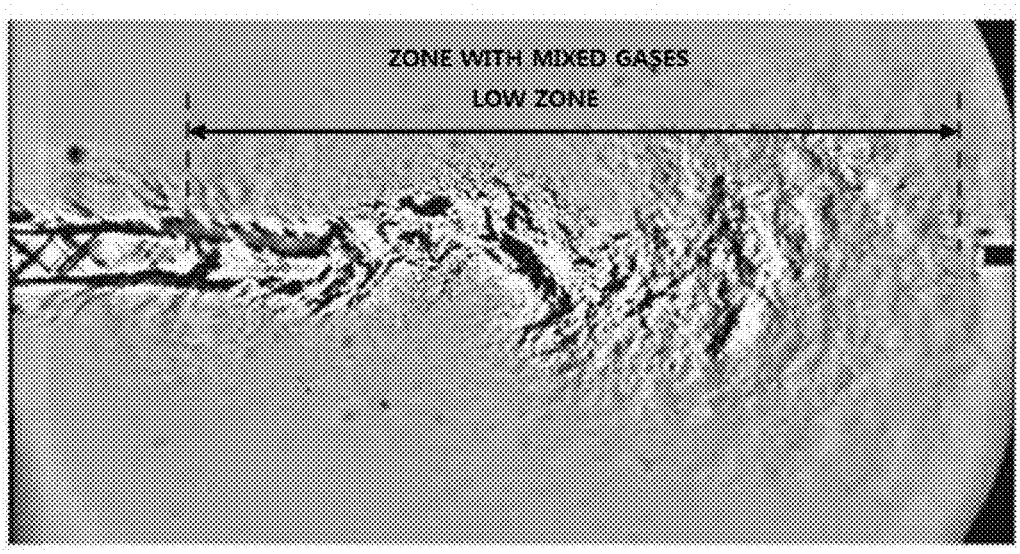
FIG. 9B illustrates a state in which exhaust gas is discharged through the exemplary tailpipe according to the present invention.

As illustrated in FIG. 9A illustrating a state in which exhaust gas is discharged through the typical tailpipe, and FIG. 9B illustrating a state in which exhaust gas is discharged through the tailpipe according to various embodiments of the present invention, the velocity $V_g$ of the exhaust gas G discharged through the typical tailpipe 3 illustrated in FIG. 9A is higher than the velocity $V_a$ of the peripheral air, such that there is a noise pattern in which gas flow noise occurs at a zone with a velocity gradient, indicated at the left side, immediately after the exhaust gas is discharged, and noise is gradually decreased at a zone, indicated at the right side, while the exhaust gas is mixed with the peripheral air after the exhaust gas is discharged.

In contrast, as illustrated in FIG. 9B illustrating a state in which exhaust gas is discharged through the tailpipe according to another exemplary embodiment of the present invention, a global velocity gradient of the velocity of the exhaust gas discharged from the tailpipe 100 according to another exemplary embodiment is produced from the upper side to the lower side, and causes a vortex of air at the periphery of the tailpipe 100 immediately after the exhaust gas is discharged. Because of this vortex, the exhaust gas is rapidly mixed with the peripheral air, and noise is rapidly reduced accordingly, thereby quickly reducing noise of the exhaust gas discharged through the tailpipe 100.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A tailpipe for a vehicle, which has a tubular body, the tailpipe comprising:

a central pipe positioned in the tubular body; and a plurality of sub-pipes disposed to surround an outer circumferential surface of the central pipe, wherein the sub-pipes include portions asymmetrically exposed to an outside of the tubular body of the tailpipe and having different lengths in an axial direction of the central pipe.

2. The tailpipe of claim 1, wherein a length of the central pipe is shorter than a length of each sub-pipe, and a diameter of the central pipe is greater than a diameter of each sub-pipe.

3. The tailpipe of claim 2, wherein the central pipe and the sub-pipes are fixed by perpendicularly penetrating a circular plate-shaped fixing plate mounted in the tubular body.

4. The tailpipe of claim 1, wherein a length of a portion of the central pipe, which is exposed to the outside of the tubular body of the tailpipe, is shorter than the length of the portions of the sub-pipes which are exposed to the outside of the tubular body.

5. The tailpipe of claim 4, wherein the central pipe and the sub-pipes are fixed by perpendicularly penetrating a circular plate-shaped fixing plate mounted in the tubular body.

6. The tailpipe of claim 1, wherein the length of the exposed portions of the sub-pipes is gradually increased from a lower side to an upper side of the central pipe.

7. The tailpipe of claim 6, wherein the central pipe and the sub-pipes are fixed by perpendicularly penetrating a circular plate-shaped fixing plate mounted in the tubular body.

8. The tailpipe of claim 1, wherein the central pipe and the sub-pipes are fixed by perpendicularly penetrating a circular plate-shaped fixing plate mounted in the tubular body.

* * * * *